US007361855B2

(12) United States Patent
Neidlein

(10) Patent No.: US 7,361,855 B2
(45) Date of Patent: Apr. 22, 2008

(54) DEVICE FOR ESTABLISHING AN ELECTRICAL CONNECTION

(75) Inventor: Hermann Neidlein, Steinheim (DE)

(73) Assignee: Magcode AG, Heidenheim (DE)

( * ) Notice: Subject to any disclaimer, the term of this patent is extended or adjusted under 35 U.S.C. 154(b) by 8 days.

(21) Appl. No.: 10/571,275

(22) PCT Filed: Sep. 3, 2004

(86) PCT No.: PCT/EP2004/009825

§ 371 (c)(1),
(2), (4) Date: Mar. 9, 2006

(87) PCT Pub. No.: WO2005/027279

PCT Pub. Date: Mar. 24, 2005

(65) Prior Publication Data

US 2007/0063586 A1 Mar. 22, 2007

(30) Foreign Application Priority Data

Sep. 11, 2003 (DE) ..... 203 14 152 U

(51) Int. Cl.
*H01H 3/16* (2006.01)

(52) U.S. Cl. ..... 200/61.7

(58) Field of Classification Search .. 200/61.41–61.44, 200/61.58 R, 61.62, 61.7, 61.73–61.76, 61.78, 200/61.81, 61.82; 439/34, 140, 188, 246, 439/247, 377

See application file for complete search history.

(56) References Cited

U.S. PATENT DOCUMENTS 595,963 A * 12/1897 McCaughey ..... 200/61.82
3,659,063 A * 4/1972 Peterson ..... 200/61.7
3,729,603 A * 4/1973 Foltz ..... 200/61.7
3,803,375 A * 4/1974 Foltz ..... 200/61.7
5,229,560 A * 7/1993 DeMarco ..... 200/61.7
6,325,633 B1 * 12/2001 Ito et al. ..... 439/34
6,486,423 B1 * 11/2002 Karasik et al. ..... 200/61.62
6,837,727 B2 * 1/2005 Migimatsu et al. ..... 439/247
6,867,382 B2 * 3/2005 Hoffman ..... 200/61.62
6,953,903 B2 * 10/2005 Berger et al. ..... 200/61.62

FOREIGN PATENT DOCUMENTS

| | | |
|---|---|---|
| DE | 296 07 244 U1 | 8/1997 |
| DE | 199 30 642 | 1/2001 |
| EP | 0573471 | 12/1993 |
| FR | 2 726 401 | 4/1996 |

* cited by examiner

*Primary Examiner*—Michael A Friedhofer
(74) *Attorney, Agent, or Firm*—Davis Bujold & Daniels, P.L.L.C.

(57) ABSTRACT

A device for establishing an electrical connection between two parts, in particular vehicle parts, which can move such that they can pivot with respect to one another about an axis, a first part (3) being provided with a current transmitter unit (1), and a second part (4) being provided with a current receiver unit (2), the current transmitter unit (1) and the current receiver unit (2) each being arranged in the region of the axis (5) such that the current receiver unit (2) and the current transmitter unit (1) come into contact with one another at least in an end position of the pivoting movement of the parts (3, 4).

18 Claims, 3 Drawing Sheets

DEVICE FOR ESTABLISHING AN ELECTRICAL CONNECTION

This application is a national stage completion of PCT/EP2004/009825 filed Sep. 3, 2004 which claims priority from German Application Serial No. 203 14152.0 filed Sep. 11, 2003.

FIELD OF THE INVENTION

The invention relates to a device for establishing an electrical connection between two parts, in particular vehicle parts, which can move such that they can pivot with respect to one another about an axis.

Parts which can move such that they can pivot with respect to one another and between which an electrical connection is required for power supply purposes are found in all sectors of engineering.

The term vehicle parts is understood to mean both motor vehicles and commercial vehicles as well as other landcraft, seacraft or aircraft. Vehicles of the abovementioned type require a power connection at a large number of different points in order to connect various terminals, such as headlamps, rear windshield heaters, windshield wipers or the like. Since the vehicles have a large number of vehicle parts which can move such that they can pivot with respect to one another, these vehicle parts need to be bridged in a reliable manner by an electrical connection in order that there is a power connection available in the desired areas.

In the case of motor vehicles or commercial vehicles, the vehicle parts which can move such that they can pivot with respect to one another are generally the vehicle frame, towards which a large number of different vehicle parts can be pivoted. In this case, this vehicle part is, for example, the tailgate (in a single-part or two-part embodiment), the doors, loading openings or the engine hood. In particular if the two vehicle parts which can move such that they can pivot with respect to one another are in the form of the vehicle frame and the tailgate, particularly high requirements need to be placed on the electrical connection between these two vehicle parts, since terminals need to be operated via the electrical connection which have a high current consumption, such as the rear windshield heater, the rear lights or a windshield wiper. Furthermore, the electrical connection also serves the purpose of supplying current to an interior lighting system fixed to the tailgate.

The end consumers mentioned are generally operated and controlled independently of one another such that a large number of individual connections is not required.

BACKGROUND OF THE INVENTION

It is known from the general prior art to arrange a free-running cable run between a vehicle frame and a tailgate, said cable run being allowed so much play that it is possible for the tailgate to be both completely opened and closed. One disadvantage here, however, is the fact that the cable run is bent or buckled by the continuous opening and closing operation of the tailgate. One complicating factor is the fact that this even takes place at relatively low temperatures, with the result that the ability of the cable run to function throughout the life of the vehicle is not reliably ensured. Owing to the play which the cable run necessarily needs to have, there is also always the risk of the cable run being ripped out or damaged by inadvertently being hooked.

SUMMARY OF THE INVENTION

The present invention is therefore based on the object of providing a device for establishing an electrical connection between two parts which can move such that they can pivot with respect to one another about an axis, which device ensures a reliable and cost-effective electrical connection.

This object is achieved according to the invention by the characterizing clause of claim 1.

Owing to the arrangement of a current transmitter unit and a current receiver unit in the region of the axis about which the movable parts are pivoted, it is possible to achieve, in a simple manner, a situation in which the current transmitter unit and the current receiver unit come into contact with one another in a reliable manner at least in an end position of the pivoting movement of the parts. Manufacturing tolerances or gap sizes in this case do not have any negative influence on the ability of the current transmitter unit to come into contact with the current receiver unit.

A cable run for bridging the two movable parts which can pivot with respect to one another is thus no longer required.

The inventor has recognized, in manner which is not obvious, that, for example when the first part is in the form of a vehicle frame and the second part is in the form of a tailgate, it is completely unproblematic for the current transmitter unit to become detached from the current receiver unit during the opening operation, since the loads, for example a rear windshield heater, a rear windshield wiper or the rear lights, do not require any current when the tailgate is in the open state. Without any loss of convenience, it is therefore possible to isolate the electrical connection between the two vehicle parts. When the tailgate is closed, the current receiver unit again makes contact with the current transmitter unit, with the result that the loads are provided with a corresponding supply. The arrangement of the current transmitter unit and the current receiver unit is not restricted to the region of the axis of the pivot joint, for example a hinge. The current transmitter unit and the current receiver unit can instead be arranged at any point along the theoretical axis of rotation.

It is advantageous that manufacturing-related and use-related tolerances in the distance between the tailgate and the vehicle frame in the closed state do not have any negative effects on the contact-making between the current transmitter unit and the current receiver unit, since the distance between the tailgate and the vehicle frame is generally not dependent on tolerances in the region of the axis.

It is advantageous if the parts which can pivot with respect to one another are connected by means of at least one hinge, and the current transmitter unit and the current receiver unit are each arranged on one hinge half.

An arrangement of the current transmitter unit and the current receiver unit on in each case one hinge half of the hinge have proven to be particularly suitable. The pivoting movement of the parts with respect to one another is essentially predetermined by the hinges, with the result that the parts also close in a particularly precise manner in terms of dimensions in the region of the hinges. As a result of the fact that no actual changes need to be made to the parts, such as holes for holders or the like, the current transmitter unit and the current receiver unit can be used in a simple manner, even retrospectively, for establishing an electrical connection between the parts.

One design-related refinement of the invention may provide for the current transmitter unit and/or the current receiver unit to be connected to the respective hinge half by means of a dovetail connection.

Such a connection is robust, can be performed in a simple manner in design terms and is cost-effective. Furthermore, it is possible in a simple manner to replace the current transmitter unit or the current receiver unit for repair purposes.

One development of the invention may provide for the surfaces, in the form of flat contacts, of the contact elements of the current transmitter unit and/or the current receiver unit to have a concave or outwardly curved shape.

Owing to the pivoting movement of the movable parts, to which the current transmitter unit and/or the current receiver unit are fixed directly or via the hinges, the current transmitter unit and the current receiver unit come into contact by means of a sequence of motions which generally corresponds to an arc (i.e. they move radially with respect to one another). The concave shape of the contact elements or the flat contacts of the current transmitter unit and/or the current receiver unit means that the flat contacts slide or rub against one another before the end position is reached. As a result, any contamination, deposits or the like are rubbed off from the contacts, with the result that reliable contact can be made in the end position.

It is advantageous here if the contact elements are elastically or resiliently mounted in the current transmitter unit and/or the current receiver unit.

This makes it possible for the contact elements of the current transmitter unit or the current receiver unit to be able to part, if appropriate, in the direction of pressure during the sliding or rubbing operation. Damage to the contact elements is thus avoided, whilst at the same time it is ensured that the contact elements or the flat contacts rub against one another in a cleaning manner. In order for them to be mounted elastically, the contact elements can be arranged on their rear sides facing away from the flat contacts in an elastic layer, for example made from rubber or silicone. The elastic layer makes it possible for the contact elements to part and move back in a defined manner. The contact elements are preferably mounted elastically, independently of one another. For this purpose, the contact elements can, for example, be mounted on a silicone cushion.

As an alternative or in addition to this, provision may also be made for the contact elements of the current transmitter unit and/or the current receiver unit to be mounted in an at least partially elastic wall of the associated current transmitter unit or the current receiver unit.

The arrangement in an at least partially elastic wall likewise makes it possible for the contact elements to part if the pressure exceeds a predetermined value. In this case, it is also advantageous that the individual contact elements can thus move independently of one another, which ensures that each contact element comes into contact with the envisaged contact element of the respective other unit without being influenced by the other contact elements. One particularly advantageous embodiment of the elastic wall is described in DE 199 30 642.

Advantageous developments and refinements of the invention will be described in the further dependent claims.

A hinge having means for connecting a current transmitter unit and a current receiver unit as claimed in one of claims 1 to 16 is described in claim 17.

BRIEF DESCRIPTION OF THE DRAWINGS

One preferred exemplary embodiment will be illustrated below using the drawing, in which.

DETAILED DESCRIPTION OF THE INVENTION

Figure 1:
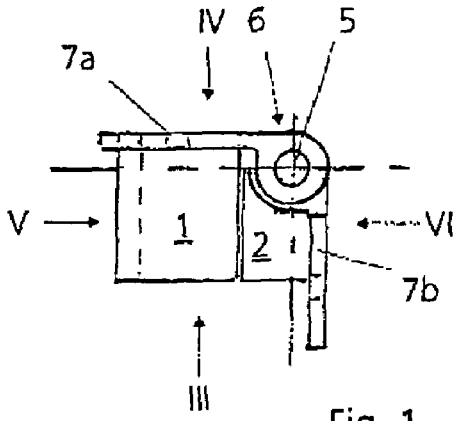
FIG. 1 shows a side view of the device according to the invention in a state in which the current transmitter unit is in contact with the current receiver unit.

As can be seen from FIG. 1 to FIG. 6, the device according to the invention for establishing an electrical connection has a current transmitter unit 1 and a current receiver unit 2. The current transmitter unit 1 is in this case arranged on a first vehicle part 3, and the current receiver unit 2 is arranged on a second vehicle part 4. The two vehicle parts 3, 4 are shown as a block diagram in FIG. 2. In this case, the first vehicle part 3 may be, for example, the frame of a vehicle (not illustrated in any more detail). The second vehicle part 4 may be in the form of, for example, a tailgate of a vehicle.

Since the specific design of the vehicle parts is not critical to the embodiment of the invention, a detailed illustration in this regard has been dispensed with.

The illustrated device according to the invention is not restricted to vehicle parts. The solution according to the invention can instead be used in all sectors of engineering.

The current transmitter unit 1 and the current receiver unit 2 are arranged in the region of an axis 5, about which the vehicle parts 3, 4 can move with respect to one another in a pivotable manner.

In the exemplary embodiment illustrated, the current transmitter unit 1 and the current receiver unit 2 are arranged on a hinge 6. In this case, the current transmitter unit 1 and the current receiver unit 2 are each arranged on one hinge half 7*a*, 7*b*. The hinge halves 7*a*, 7*b* are separated by the axis of the hinge 6. The axis of the hinge 6 consequently corresponds to the axis 5, about which the vehicle parts 3, 4 can be pivoted with respect to one another.

In the exemplary embodiment, the current transmitter unit 1 and the current receiver unit 2 are arranged on the hinge 6, but the invention is not restricted to this embodiment. The current transmitter unit 1 and the current receiver unit 2 can be arranged at any desired point along a theoretical axis, about which the vehicle parts 3, 4 can be pivoted with respect to one another. An actual axis of rotation or pivoting axis does not need to be provided for this purpose; it is sufficient for the current transmitter unit 1 or the current receiver unit 2 to be arranged along a theoretical pivoting axis, about which the vehicle parts 3, 4 can be pivoted.

As shown in FIG. 1, the current transmitter unit 1 and the current receiver unit 2 come into contact in an end position of the pivoting movement of the vehicle parts 3, 4. This end position may be, for example, a position in which the tailgate of the vehicle is closed. The tailgate may be a single-part or two-part tailgate.

The exemplary embodiment provides for the current transmitter unit 1 and the current receiver unit 2 to be connected to the respective hinge half 7*a*, 7*b* by means of a dovetail connection 8, 9.

Figure 3:
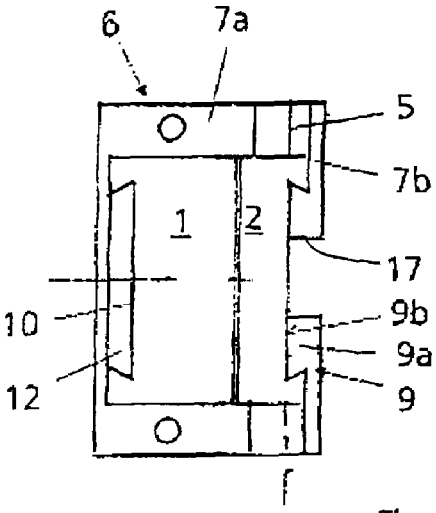
FIG. 3 shows a plan view of the device according to the invention in accordance with the arrow direction III in FIG. 1.
Figure 5:
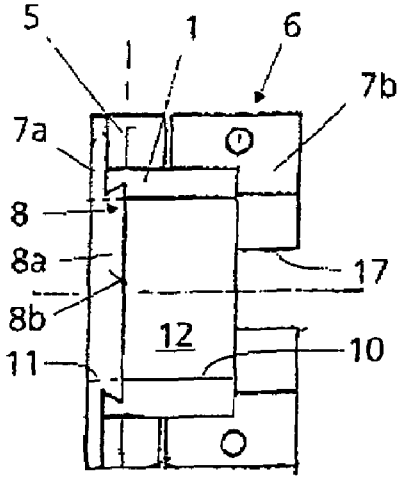
FIG. 5 shows a view of the device according to the invention in accordance with the arrow direction V in FIG. 1.
Figure 6:
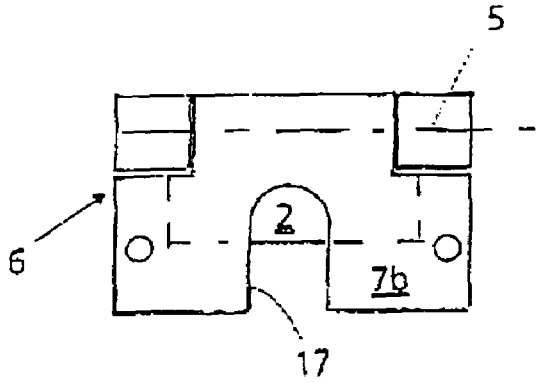
FIG. 6 shows a view of the device according to the invention in accordance with the arrow direction VI in FIG. 1.

As can be seen in the exemplary embodiment shown in FIG. 3, in this case the hinge half 7*b* has a dovetail-like projection 9*a* in order to connect it to the current receiver unit 2. The current receiver unit 2 correspondingly has a dovetail-shaped receptacle 9*b*. Analogously, as can be seen in FIG. 5, the hinge half 7*a*, which is provided for the arrangement of the current transmitter unit 1, is provided with a dovetail-like projection 8*a*. The current transmitter unit 1 correspondingly has a dovetail-shaped receptacle 8*b*, with the result that a dovetail connection 8 is formed between the current transmitter unit 1 and the hinge half 7*a*.

The arrangement of the current transmitter unit 1 or the current receiver unit 2 on the hinge 6 is thus possible in a simple manner. If required, the connection can be detached again in a likewise simple manner. In order to prevent the current transmitter unit 1 or the current receiver unit 2 from being detached unintentionally, an additional fixing may be provided by means of a screw or the like (not illustrated in any more detail).

Figure 2:
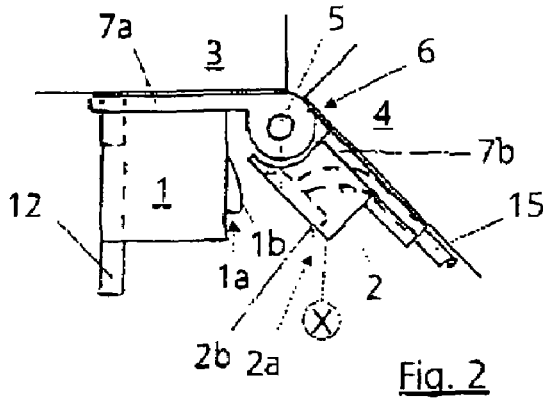
FIG. 2 shows a side view of the device according to the invention in a state in which the current transmitter unit is not in contact with the current receiver unit.

FIG. 2 shows contact elements 1*a* of the current transmitter unit 1 and (using dashed lines) contact elements 2*a* of the current receiver unit 2. The contact elements 1*a*, 2*a* each have a surface in the form of a flat contact 1*b*, 2*b* for contact-making purposes. The contact elements 1*a* and 2*a* are arranged such that they or their flat contacts 1*b*, 2*b* come into contact with one another in the end position illustrated in FIG. 1. The contact elements 1*a* and 2*a* will be described in more detail below.

Figure 4:
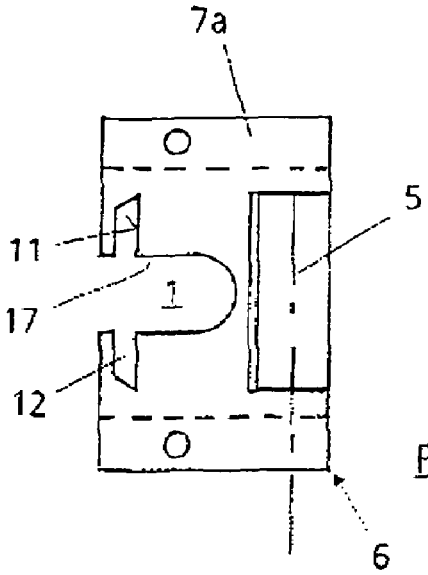
FIG. 4 shows a view of the device according to the invention in accordance with the arrow direction IV in FIG. 1.
Figure 8:
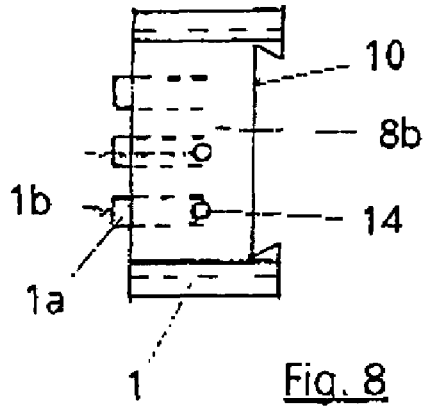
FIG. 8 shows a side view of the current transmitter unit in accordance with the arrow direction VIII in FIG. 7.
Figure 13:
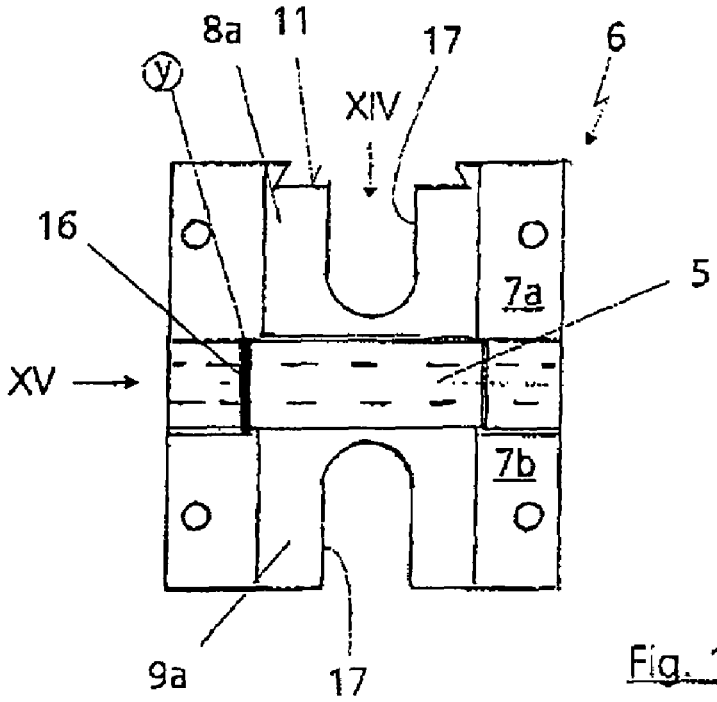
FIG. 13 shows a plan view of a hinge having means for connecting a current transmitter unit and a current receiver unit.

The current transmitter unit 1 has a dovetail-shaped receptacle 10 on its rear side facing away from the flat contacts 1*b*. The dovetail-shaped receptacle 10 can be seen in FIG. 3 and FIG. 8. In FIG. 1 and FIG. 2, the dovetail-shaped receptacle 10 is illustrated using dashed lines. The dovetail-shaped receptacle 10 is aligned with a dovetail-shaped receptacle 11 of the hinge half 7*a*. This dovetail-shaped receptacle 11 is illustrated in FIG. 4 and FIG. 13. In this case, FIG. 1 and FIG. 2 likewise show the dovetail-shaped receptacle 11 using dashed lines. The dovetail-shaped receptacle 10, in conjunction with the dovetail-shaped receptacle 11, serves the purpose of fixing the current transmitter unit 1 on the hinge half 7*a*. For this purpose, as illustrated in FIG. 2, a rear wall or a fixing plate 12 is inserted into the dovetail-shaped receptacle 10 and the dovetail-shaped receptacle 11. The fixing plate 12 thus passes through both the dovetail-shaped receptacle 10 of the current transmitter unit 1 and the dovetail-shaped receptacle 11 of the hinge half 7*a*. Owing to the fixing plate 12 and the dovetail-shaped receptacles 10, 11, it is no longer possible for the dovetail connection 8 between the current transmitter unit 1 and the hinge half 7*a* to be detached.

The fixing plate 12 makes it possible to fix the current transmitter unit 1 without any holes being required, which would restrict the interior of the current transmitter unit 1.

The current transmitter unit 1 and the current receiver unit 2 may each have a plastic housing. The contact elements 1*a* and 2*a* are arranged in the current transmitter unit 1 and, respectively, the current receiver unit 2 and/or are designed in terms of their shape such that the flat contacts 1*a*, 1*b* of the contact elements 1*a*, 2*a* rub against one another before the end position illustrated in FIG. 1 is reached.

Figure 9:
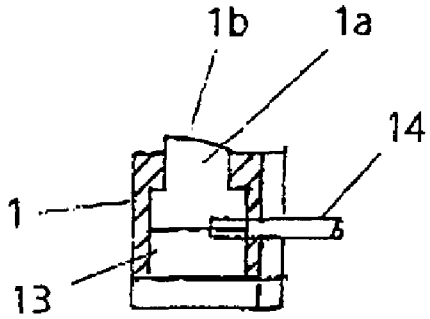
FIG. 9 shows a section along the line IX-IX in FIG. 7 through the current transmitter unit.

In addition, FIG. 2 shows a preferred refinement of the contact elements 1*a* and the contact elements 2*a*. FIG. 9 shows a section through a preferred refinement of a current transmitter unit 1 having contact elements 1*a*.

As can be seen in FIG. 2 and FIG. 9, the flat contacts 1*b* of the contact elements 1*a* in a preferred embodiment have a concave or outwardly curved shape. As an alternative or in addition to this, the flat contacts 2*b* of the contact elements 2*a* of the current receiver unit 2 can also have a concave shape. The concave shape causes the contact elements 1*a*, 2*a* to come into contact with one another before the end position is reached. The flat contacts 1*b*, 2*b* therefore have any contamination or deposits removed from them.

In the embodiment of the current transmitter unit 1 illustrated as being preferred in FIG. 9, provision is made for the contact elements 1*a* to be mounted elastically. For this purpose, the current transmitter unit 1 has an elastic layer 13, for example made from silicone or rubber, which is arranged on the rear side which faces away from the flat contacts 1*b* of the contact elements 1*a*. The elastic layer 13 makes it possible for the contact elements 1*a* to move back in the direction of the elastic layer 13 above a specific pressure, which is produced by said contact elements 1*a* coming into contact with the contact elements 2*a*.

As an alternative or in addition to the elastic mounting of the contact elements 1*a*, the contact elements 2*a* can also be elastically mounted. Elastic mounting of the contact elements 1*a* is sufficient, however.

As an alternative to the flat contacts 1*b* having a concave shape, provision may also be made for the current transmitter unit 1 or, if appropriate, the current receiver unit 2 to have a concave surface, into which the flat contacts 1*b* or, if appropriate, the flat contacts 2*b* are inserted.

In a further embodiment (not illustrated), provision may also be made for the contact elements 1*a*, 2*a* of the current transmitter unit and, respectively, the current receiver unit 2 to be mounted in an at least partially elastic wall of the associated current transmitter unit 1 or the current receiver unit 2. In this case, the contact elements 1*a*, 2*a* can be cast or inserted in a fluid-tight manner into the at least partially elastic wall. The at least partially elastic wall may be in the form of, for example, a plastic membrane. One particularly preferred embodiment for this is described in DE 199 30 642, to which reference is made in this regard.

Figure 7:
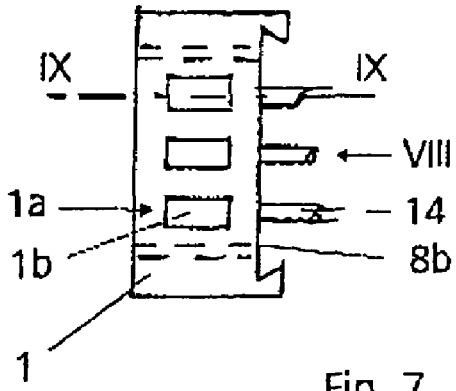
FIG. 7 shows a plan view of the current transmitter unit.

As can also be seen in FIG. 9 in conjunction with FIG. 7, the contact elements 1*a* are each connected to power supply lines 14, which lead to a current source (not illustrated).

As can be seen from the drawing, the current transmitter unit 1 in the exemplary embodiment has three contact elements 1*a*. The current receiver unit 2 correspondingly likewise has three contact elements 2*a*. Any other desired number of contact elements 1*a*, 2*a* is of course also possible for this purpose. The contact elements 1*a*, 2*a* can be used, for example, for supplying power to a rear windshield heater, a rear windshield wiper and rear lights.

Figure 10:
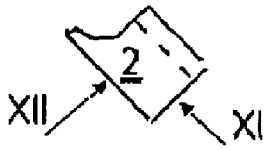
FIG. 10 shows a detailed illustration of the current transmitter unit in accordance with the detail X in FIG. 2.

As can be seen in FIG. 1, FIG. 2 and, in particular, FIG. 10, the current receiver unit 2 has a radius which at least partially surrounds the axis 5 of the hinge 6. This results in a particularly advantageous connection between the contact elements 2*a* and the contact elements 1*a*.

Figure 11:
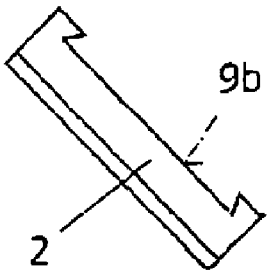
FIG. 11 shows a side view of the current transmitter unit in accordance with the arrow direction XI in FIG. 10.

FIG. 11 shows the dovetail-shaped receptacle 9*b* of the current receiver unit 2 for connection to the dovetail-like projection 9*a* of the hinge half 7*b*.

Figure 12:
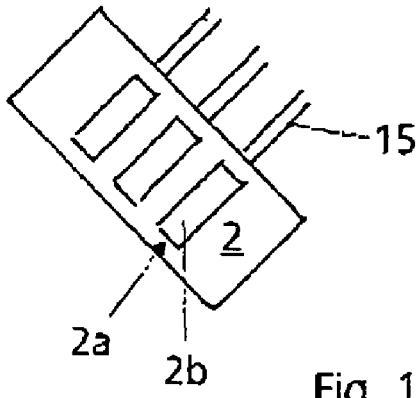
FIG. 12 shows a plan view of the current transmitter unit in accordance with the arrow direction XII in FIG. 10.

FIG. 12 shows the contact elements 2*a*, which, analogously to the contact elements 1*a*, have flat contacts 2*b* having an essentially rectangular shape. The contact elements 2*a* are each connected to a line 15, which leads to a load.

FIGS. 13 to 17 show the hinge 6 having means for connecting the current transmitter unit 1 and the current receiver unit 2, in detail.

As can be seen in FIG. 13, the two hinge halves 7*a*, 7*b* have cutouts 17, through which the power supply lines 14 to the current transmitter unit 1 or the lines 15 from the current receiver unit 2 to a load can be passed in a simple manner. FIG. 13 also shows the dovetail-shaped receptacle 11, which is intended to be fixed to the fixing plate 12, as already described. Such a dovetail-shaped receptacle 11 can also be provided for fixing the current receiver unit 2 in the hinge half 7*b*.

Figure 14:
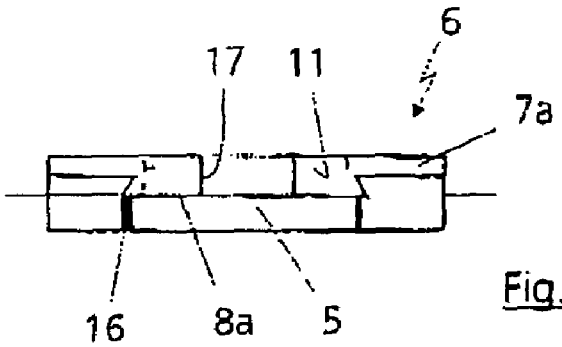
FIG. 14 shows an end-face view of the hinge in accordance with the arrow direction XIV in FIG. 13.
Figure 15:
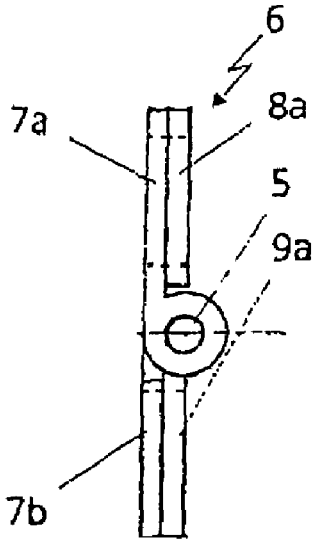
FIG. 15 shows a side view of the hinge in accordance with the arrow direction XV in FIG. 13.

The dovetail-shaped receptacle 11 runs at an angle of 90° with respect to the dovetail-like projection 8*a*, as can be seen from FIG. 13 in conjunction with FIG. 14.

Figure 16:
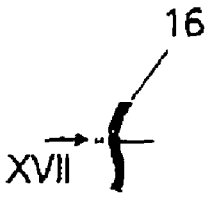
FIG. 16 shows an individual contact element in the form of a spring disk in accordance with the detail Y in FIG. 13.
Figure 17:
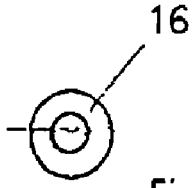
FIG. 17 shows a side view of the individual contact element in accordance with the arrow direction XVII in FIG. 16.

FIGS. 13 and 14, and in detail FIGS. 16 and 17, show an individual contact element 16 for establishing an electrical connection between the two hinge halves 7*a*, 7*b*. The individual contact element 16 is in this case arranged on the axis 5. In this case, the exemplary embodiment provides for the individual contact element to be in the form of a spring disk 16, as is illustrated in FIG. 16 and FIG. 17. The spring disk 16 in this case serves the purpose of transmitting a low-volt voltage from the hinge half 7*a* to the hinge half 7*b*. It is thus advantageously possible for a voltage to be transmitted even in the open state of the hinge 6, i.e. when the contact elements 1*a* are not in contact with the contact elements 2*a*. The spring disk 16 can be used, for example, for supplying power to an interior lighting system.

In one alternative embodiment, the current transmitter unit 1 and the current receiver unit 2 can be provided with a magnetic triggering device, as is described in EP 0 573 471.

The invention claimed is:

1. A device for establishing an electrical connection between first and second parts which can move such that the first and second parts can pivot with respect to one another about an axis (5) the device comprising:

a current transmitter unit (1) associated with the first part (3) and a current receiver unit (2) associated the second part (4);

the current transmitter unit (1) and the current receiver unit (2) each being arranged in a region of the axis (5) such that the current receiver unit (2) and the current transmitter unit (1) come into contact with one another at least in an end position of the pivoting movement of the first and the second parts (3,4);

wherein contact elements (1*a*, 2*a*) of the current transmitter unit (1) and the current receiver unit (2) are arranged and shape such that the contact elements (1*a*, 2*a*) rub against one another before the end position of the first and the second parts (3, 4) is reached; and the contact elements (1*a*) of the current transmitter unit (1) and the contact elements (2*a*) of the current receiver unit (2) are mounted in an at least partially elastic wall of the associated current transmitter unit (1) or the current receiver unit (2).

2. The device as claimed in claim 1, wherein the contact elements (1*a*, 2*a*) are cast or inserted in a fluid-tight manner into the at least partially elastic wall.

3. A device for establishing an electrical connection between first and second parts which can move such that the first and the second parts can pivot with respect to one another about an axis (5) the device comprising:

a current transmitter unit (1) associated with the first part (3) and a current receiver unit (2) associated the second part (4);

the current transmitter unit (1) and the current receiver unit (2) each being arranged in a region of the axis (5) such that the current receiver unit (2) and the current transmitter unit (1) come into contact with one another at least in an end position of the pivoting movement of the first and second parts (3, 4);

wherein contact elements (1*a*2*a*) of the current transmitter unit (1) and the current receiver unit (2) are arranged and designed in terms of shape such that the contact elements (1*a*, 2*a*) rub against one another before the end position of the first and second parts (3, 4) is reached;

the contact elements (1*a*) of the current transmitter unit (1) and the contact elements (2*a*) of the current receiver unit (2) are mounted in an at least partially elastic wall of the associated current transmitter unit (1) or the current receiver unit (2);

the first and the second parts (3,4) are connected such that they pivot by at least one hinge (6), and the current transmitter unit (1) and the current receiver unit (2) have a dovetail-shaped receptacle (10) in each case on a rear side facing away at least one of the current transmitter unit (1) and the current receiver unit (2) have a dovetail-shaped receptacle (10) in each case on a rear side facing away from a flat contacts (1*b*, 2*b*), said dovetail-shaped receptacle (10) being aligned with a dovetail-shaped receptacle (11) of the respective hinge half (7*a*, 7*b*) for the purpose of accommodating a fixing plate (12).

4. The device as claimed in claim 3, wherein the current receiver unit (2), which is arranged on the second vehicle part (4), has a radius which partially surrounds the axis (5) of the hinge (6).

5. A hinge for connecting a current transmitter transmitter unit (1) and a current receiver unit (2), the hinge comprising:

a first part (3) and a second part (4) which can pivot with respect to one another about an axis (5), the current transmitter unit (1) being connected with a first one of the first part (3) and the second part (4) and the current receiver unit (2) being connected with a second one of the first part (3) and the second part (4);

the current transmitter unit (1) and the current receiver unit (2) each being arranged in a region of the axis (5)

such that the current receiver unit (2) and the current transmitter unit (1) come into contact with one another at least in an end position of the pivoting movement of the first and second parts (3, 4);

contact elements (1*a*, 2*a*) of the current transmitter unit (1) and the current receiver unit (2) are arranged and shaped such that the contact elements (1*a*, 2*a*) rub against one another before the end position of the first and second parts (3, 4) is reached; and the two hinge halves (7*a*, 7*b*) each have a dovetail-shaped receptacle or a dovetail-like projection (8*a*, 9*a*) on their surfaces provided for connecting the current transmitter unit (1) or the current receiver unit (2), for the purpose of forming a dovetail connection (8, 9) for connecting the current transmitter unit (1) or the current receiver unit (2).

6. The hinge as claimed in claim 5, wherein the dovetail-shaped receptacle (11) and the dovetail-like projection (8*a*, 9*a*) of the two hinge halves (7*a*, 7*b*), extend essentially at right angles to the dovetail connection (8 or 9) and face away from the common axis (5).

7. The hinge as claimed in claim 5, wherein the hinge halves (7*a*, 7*b*) have cutouts (17) for the purpose of passing through lines (14, 15).

8. A hinge connector for electrically connecting a first current transmission unit (1) and a second current transmission unit (2), comprising:

first and second parts (3, 4) pivoting about a common axis (5) and respectively supporting the first and second current transmission units (1, 2), the first and second current transmission units (1, 2) respectively including first and second contact element surfaces (l*a*, 2*a*) extending parallel to and radially offset from the common axis (5), wherein during rotation from a non-connected rotational position to a connected rotational position, a first one of the contact element surfaces (1*a*, 2*a*) traverses an arc-like path that in at least a terminal part of the arc-like path includes motions perpendicular to and parallel to the second one of the contact element surfaces (1*a*, 2*a*) to cause a rubbing contact between the contact element surfaces (1*a*, 2*a*).

9. The device as claimed in claim 8, wherein the contact elements (1*a*, 2*a*) each have a surface in the form of flat contacts (1*b*, 2*b*).

10. The device as claimed in claim 8, wherein the contact elements (1*a*, 2*a*) or their surface in the form of a flat contact (1*b*, 2*b*) have a concave or outwardly curved shape.

11. The device as claimed in claim 8, wherein the current transmitter unit (1) and the current receiver unit (2) have a concave surface, into which the respective contact elements (1*a*, 2*a*) or their flat contacts (1*b*, 2*b*) are inserted.

12. The device as claimed in claim 8, wherein the first and second parts (3, 4) are connected such that they pivot by at least one hinge (6), and the current transmitter unit (1) and the current receiver unit (2) are each arranged on one hinge half (7*a*, 7*b*).

13. The device as claimed in claim 12, wherein the current transmitter unit (1) and the current receiver unit (2) are connected to the respective hinge half (7*a*, 7*b*) by a dovetail connection (8, 9).

14. The device as claimed in claim 8, wherein the first part is in the form of a first vehicle part (3) and the second part is in the form of a second vehicle part (4).

15. The device as claimed in claim 8, wherein the current transmitter unit (1) and the current receiver unit (2) are arranged such that the current transmitter unit (1) and the current receiver unit (2) are in contact with one another in the closed state of a second vehicle part (4).

16. The device as claimed in claim 8, wherein the current transmitter unit (1) and the current transmitter unit (2) have a plastic housing.

17. The device as claimed in claim 8, wherein the first and the second parts (3, 4) are connected such that those parts (3, 4) pivot about at least one hinge (6) and an axis of the hinge (6) is provided with an individual contact element (16) for establishing an electrical connection.

18. The device as claimed in claim 17, wherein the individual contact element is in the form of a spring disk (16) for the purpose of transmitting a low-volt voltage from one hinge half (7*a*) to the other hinge half (7*b*).

* * * * *

UNITED STATES PATENT AND TRADEMARK OFFICE

CERTIFICATE OF CORRECTION

PATENT NO. : 7,361,855 B2
APPLICATION NO. : 10/571275
DATED : April 22, 2008
INVENTOR(S) : Hermann Neidlein It is certified that error appears in the above-identified patent and that said Letters Patent is hereby corrected as shown below:

On the Title Page, Item (73)
Replace "Magcode AG" with --MagCode AG--;

Column 7, line 62
Replace "an axis (5) the" with --an axis (5), the--;

Column 8, line 21
Replace "an axis (5) the" with --an axis (5), the--;

Column 8, line 31
Replace "elements (la2a)" with --elements (1a, 2a)--;

Column 8, lines 45-46
Replace "receiver unit (2) have a dovetail-shaped receptacle (10) in each case on a rear side facing away" with --receiver unit (2) are each arranged on one hinge half (7a, 7b); and--; and Column 8, line 58
Replace "current transmitter transmitter unit (1)" with --current transmitter unit (1)--.

Signed and Sealed this

Nineteenth Day of August, 2008

JON W. DUDAS
*Director of the United States Patent and Trademark Office*